US006670759B1

(12) United States Patent
Katase et al.

(10) Patent No.: US 6,670,759 B1
(45) Date of Patent: Dec. 30, 2003

(54) ELECTRODELESS DISCHARGE LAMP

(75) Inventors: Koichi Katase, Osaka (JP); Tsuyoshi Ichibakase, Takatsuki (JP); Katsushi Seki, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/577,770

(22) Filed: May 24, 2000

(30) Foreign Application Priority Data

May 25, 1999 (JP) ..... 11-145489

(51) Int. Cl.[7] ..... H01J 17/20
(52) U.S. Cl. ..... 313/638; 313/637; 313/643
(58) Field of Search ..... 313/638, 637, 313/643

(56) References Cited

U.S. PATENT DOCUMENTS

| | | | | | |
|---|---|---|---|---|---|
| 4,206,387 | A | * | 6/1980 | Kramer et al. | 315/248 |
| 5,864,210 | A | | 1/1999 | Hochi et al. | 313/641 |
| 5,866,981 | A | * | 2/1999 | Saimi et al. | 313/570 |
| 6,137,237 | A | * | 10/2000 | MacLennan et al. | 315/248 |
| 6,249,078 | B1 | * | 6/2001 | Mimasu | 313/161 |
| 6,476,557 | B1 | * | 11/2002 | Leng et al. | 313/637 |

FOREIGN PATENT DOCUMENTS

| | | | |
|---|---|---|---|
| JP | 6-132018 | | 5/1994 |
| JP | 08329889 A | * | 12/1996 |
| JP | 9-120800 | | 5/1997 |
| JP | 10-326597 | | 12/1998 |
| JP | 2000-11952 | | 1/2000 |
| WO | PCT/US91/07865 | | 5/1992 |
| WO | WO 99/65052 | | 12/1999 |

OTHER PUBLICATIONS

Japanese Office Action dated Jan. 16, 2001, corresponding to Japanese Patent Application No. 11–145489, filed Dec. 22, 2000, 2 pages.

Patent Abstracts of Japan, Publication No. 10326597 A, dated Dec. 8, 1998, 1 page.

* cited by examiner

*Primary Examiner*—Craig E. Church
*Assistant Examiner*—Jurie Yun
(74) *Attorney, Agent, or Firm*—Rosenthal & Osha L.L.P.

(57) ABSTRACT

An electrodeless discharge lamp includes an envelope filled with a luminescent material to be excited to emit light and a filling material that substantially does not discharge to emit light. The filling material stabilizes a discharge of the luminescent material.

10 Claims, 5 Drawing Sheets

ELECTRODELESS DISCHARGE LAMP

BACKGROUND OF THE INVENTION

1. Technical Field

The invention relates generally to electrodeless discharge lamps.

2. Background Art

FIG. 5 shows a schematic view of a conventional electrodeless discharge lamp device that uses microwave energy as an excitation means. The electrodeless discharge lamp device includes a magnetron 1 for generating microwaves of 2.45 GHz, a cavity member 2*a*, a waveguide 5 for transmitting the microwaves generated by the magnetron 1 into the cavity member 2*a*, an electrodeless discharge lamp 4 supported within the cavity member 2*a* by a supporting rod 4*a*, a motor 6 connected to the supporting rod 4*a* for rotating the electrodeless discharge lamp 4, and a cooling fan 7 for cooling the magnetron 1. The electrodeless discharge lamp 4 is created by sealing a buffer gas, which is a noble gas, and a luminescent material in a transparent envelope (or discharge tube) such as a quartz glass tube or the like. The cavity member 2*a* is formed in a cylindrical shape from a conductive material such as a conductive mesh material that does not substantially transmit a microwave but that transmits light. The cavity member 2*a* is created, for example, by welding a metal mesh plate formed by etching. The cavity member 2*a* is also provided with a strong electrical connection to the waveguide 5. The space defined by the cavity member 2*a* and a part of the wall face of the waveguide 5 is called a microwave cavity 2. The microwave cavity 2 communicates with a transmission space inside the waveguide 5 via a power-supply port 3 provided in a wall of the waveguide 5.

The magnetron 1 is positioned with its antenna inserted into the waveguide 5. Microwaves generated by the magnetron 1 are transmitted inside the waveguide 5 from the antenna and are supplied to the microwave cavity 2 through the power-supply port 3. The microwave energy excites the luminescent material within the electrodeless discharge lamp 4, thus allowing the luminescent material to emit light. During the light emission process, the noble gas initially starts to discharge, which causes high temperatures within the electrodeless discharge lamp 4 and a rise in the vapor pressure of the noble gas. As a result, the luminescent material is evaporated and starts to discharge. Subsequently, the vapor pressure of the luminescent material rises and its molecules are excited by the microwave energy to emit light. Consequently, white light with a wide continuous spectrum over the entire visible range is emitted. The light emitted from the electrodeless discharge lamp 4 passes through the cavity member 2*a* to the outside of the microwave cavity 2.

During operation of the electrodeless discharge lamp 4, the discharge tube wall of the electrodeless discharge lamp 4 tends to have a very high temperature. This is because plasma generated by the microwaves inside the electrodeless discharge lamp 4 spreads inside the tube and, therefore, is present in the vicinity of the inner wall of the electrodeless discharge lamp 4. In this way, the tube wall is exposed to a high temperature. Furthermore, the tube wall of the electrodeless discharge lamp 4 tends to have an uneven temperature distribution because the distribution of the microwave electromagnetic-field strength which determines the plasma density is not three-dimensionally symmetric with respect to the center of the electrodeless discharge lamp 4. Heat transfer due to a convection current inside the tube also contributes to the uneven temperature distribution at the tube wall of the electrodeless discharge lamp 4. The high temperature and uneven temperature distribution in the tube wall of the electrodeless discharge lamp 4 may result in localized high-temperature regions in the material forming the discharge tube wall. Unless the temperature of the discharge tube wall is controlled, these localized high-temperature regions may melt and, thus, result in damage of the discharge tube. In the electrodeless discharge lamp 4 shown in FIG. 5, damage to the discharge tube is prevented by rotating the discharge tube at a moderate speed to obtain a cooling effect which maintains the temperature of the discharge tube substantially uniform.

Various types of luminescent materials are known in the art. However, the selection of luminescent material can affect the temperature of the discharge tube of the electrodeless discharge lamp. For example, the temperature rise in the discharge tube of electrodeless discharge lamps which use sulfur as the luminescent material, e.g., the discharge lamp disclosed in JP 6-132018 A, is considerable. In particular, the microwave energy required to obtain a suitable lamp output results in a temperature which causes the discharge tube to melt easily unless the temperature is controlled. One possible reason for the high temperature is that sulfur has a relatively light atomic weight so that the heat transfer tends to occur inside the electrodeless discharge lamp. Consequently, in the electrodeless discharge lamps which use sulfur as the luminescent material, the discharge tube is initially air-cooled by forcibly blowing cooling air to the discharge tube, and then rotating the discharge tube.

On the other hand, when electrodeless discharge lamps which use indium halide as the luminescent material, e.g., the discharge lamp disclosed in JP 9-120800, are operated under conditions which enable suitable lamp output to be obtained, they do not produce as high a temperature as the electrodeless discharge lamps which use sulfur. Indium-halide electrodeless discharge lamps, however, have a slightly lower luminous efficacy than sulfur electrodeless discharge lamps but are excellent in color rendering. One possible reason for the differences in the temperatures generated by the indium-halide and sulfur electrodeless discharge lamps is that indium halide and sulfur have different gas pressures and molecular weights in operation and, thus, different heat transfer coefficients from the plasma to the tube wall. Therefore, in the electrodeless indium lamp, there is a high possibility that the lamp may be operated without causing a damage to the discharge tube and without employing both the forced-air cooling and the rotating operation of the discharge tube. Actually, when the indium-halide electrodeless lamp is operated without being rotated, the highest temperature in the tube wall is typically not sufficient to damage the discharge tube, even though the temperature in the discharge tube is uneven.

FIG. 3 compares lamp outputs under rotating and non-rotating conditions. In FIG. 3, the horizontal axis indicates supplied microwave power, the vertical axis on the left indicates a luminous flux of a lamp, and the vertical axis on the right indicates the highest temperature of the tube wall. The data a, indicated with X and a broken line, shows the highest temperatures of the tube wall when the lamp is operated without rotating the discharge tube, and the data b, indicated with X and a solid line, shows luminous flux values when the lamp is operated without rotating the discharge tube. The data c, indicated with ○ and a solid line, shows luminous flux values when the lamp is operated while rotating the discharge tube, and the data d, indicated with ○ and a broken line, shows the highest temperatures of the tube wall when the lamp is operated while rotating the discharge tube. When the lamp is operated without rotating the discharge tube, the highest temperatures of the tube wall are very high, but do not reach a melting temperature (at least 1100° C.) of the discharge tube. The luminous flux values when the discharge tube is rotated does not vary greatly from when the discharge tube is not rotated.

In conventional electrodeless discharge lamp devices, there has been a fear that the mechanism for rotating the discharge tube, for example, the motor 6 shown in FIG. 5, may limit the life span of the lamp device when the lamp device is installed in a severe working environment, e.g., in the open air or the like. Thus, the option of operating an electrodeless discharge lamp device without rotating the discharge tube is quite attractive. However, when the indium-halide electrodeless discharge lamp is operated without being rotated, and the microwave power is increased, discharges tend to be unstable, thus causing flickering. The instability in the discharges occur because the halogen liberated from the indium halide as the vapor pressure inside the tube increases traps electrons in the plasma. To achieve stable lighting, the upper limit of the microwave power has typically been limited, thus limiting the lamp output.

SUMMARY OF THE INVENTION

In one aspect, the invention relates to an electrodeless discharge lamp which comprises an envelope filled with a luminescent material to be excited to emit light and a filling material that substantially does not discharge to emit light. The filling material stabilizes a discharge of the luminescent material.

In another aspect, the invention relates to an electrodeless discharge lamp device, which comprises an electrodeless discharge lamp having an envelope filled with a luminescent material to be excited to emit light and a filling material that substantially does not emit light, wherein the filling material stabilizes the discharge of the luminescent material and means for exciting the luminescent material.

In another aspect, the invention relates to an electrodeless discharge lamp device, which comprises an electrodeless discharge lamp having an envelope filled with a luminescent material to be excited to emit light and means for stabilizing discharge of the luminescent material.

In another aspect, the invention relates to a method for producing a stabilized discharge in an electrodeless discharge lamp, which comprises filling an envelope of the electrodeless discharge lamp with a luminescent material and a filling material and exciting the luminescent material to emit light; wherein the filling material stabilizes the emitted light.

DETAILED DESCRIPTION OF THE INVENTION

In an example of the electrodeless discharge lamp according to the present invention, it is preferable that a fill amount of the cesium halide is n times as large as a fill amount of the luminescent material, where n equals $(0.0005\times P)-0.28$, where P denotes an input electric power to the lamp.

In addition, in an example of the electrodeless discharge lamp according to the present invention, it is preferable that a fill amount of the luminescent material is in a range between $0.5\times10^{-6}$ mol/cc and $1.0\times10^{-4}$ mol/cc.

Figure 1:
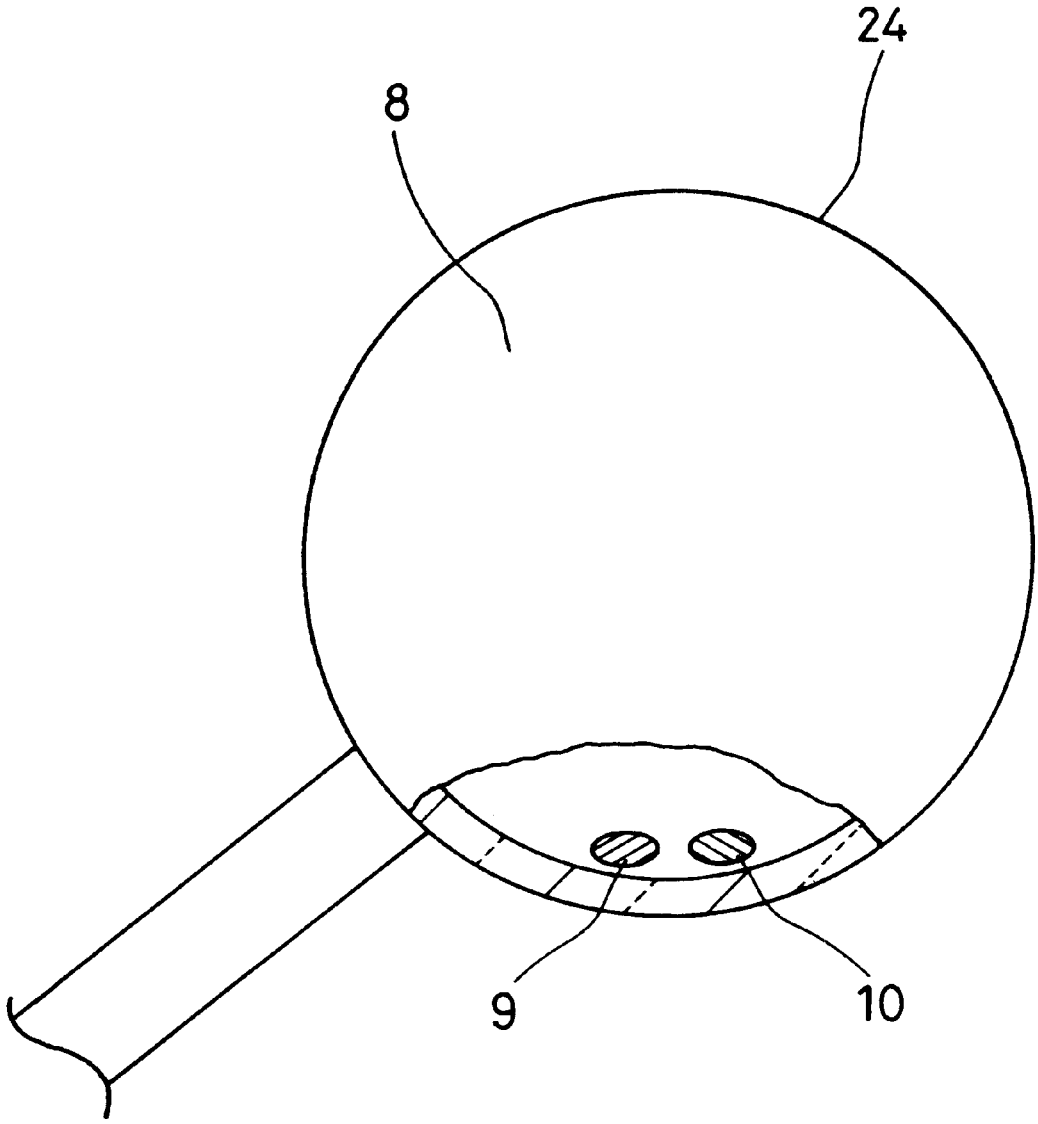
FIG. 1 depicts a partial cutaway section of an electrodeless discharge lamp according to an embodiment of the invention.

Various exemplary embodiments of the invention will now be discussed with reference to the accompanying figures. FIG. 1 shows a partial cutaway section of an electrodeless discharge lamp 24. The electrodeless discharge lamp 24 includes a luminescent material 9 and a stabilizing material 10 sealed within an envelope (or discharge tube) 8 which is formed of a high heat-resistant, transparent material such as quartz glass. The envelope 8 is filled with a noble gas such as argon (Ar), or the like, which initially heats the envelope 8. In this embodiment, the luminescent material 9 is an indium halide, and the stabilizing material 10 is cesium halide. The stabilizing material 10 stabilizes the light emitted from the luminescent material 9. After a discharge has started, the stabilizing material 10, which has a low ionization potential, increases the charged particles of electrons or the like so that the discharge is prevented from being contracted and is sustained. Thus, a stable discharge from the luminescent material 9 is achieved. In other embodiments, the luminescent material 9 may be indium bromide (InBr), and the stabilizing material 10 may be cesium bromide (CsBr).

Figure 2:
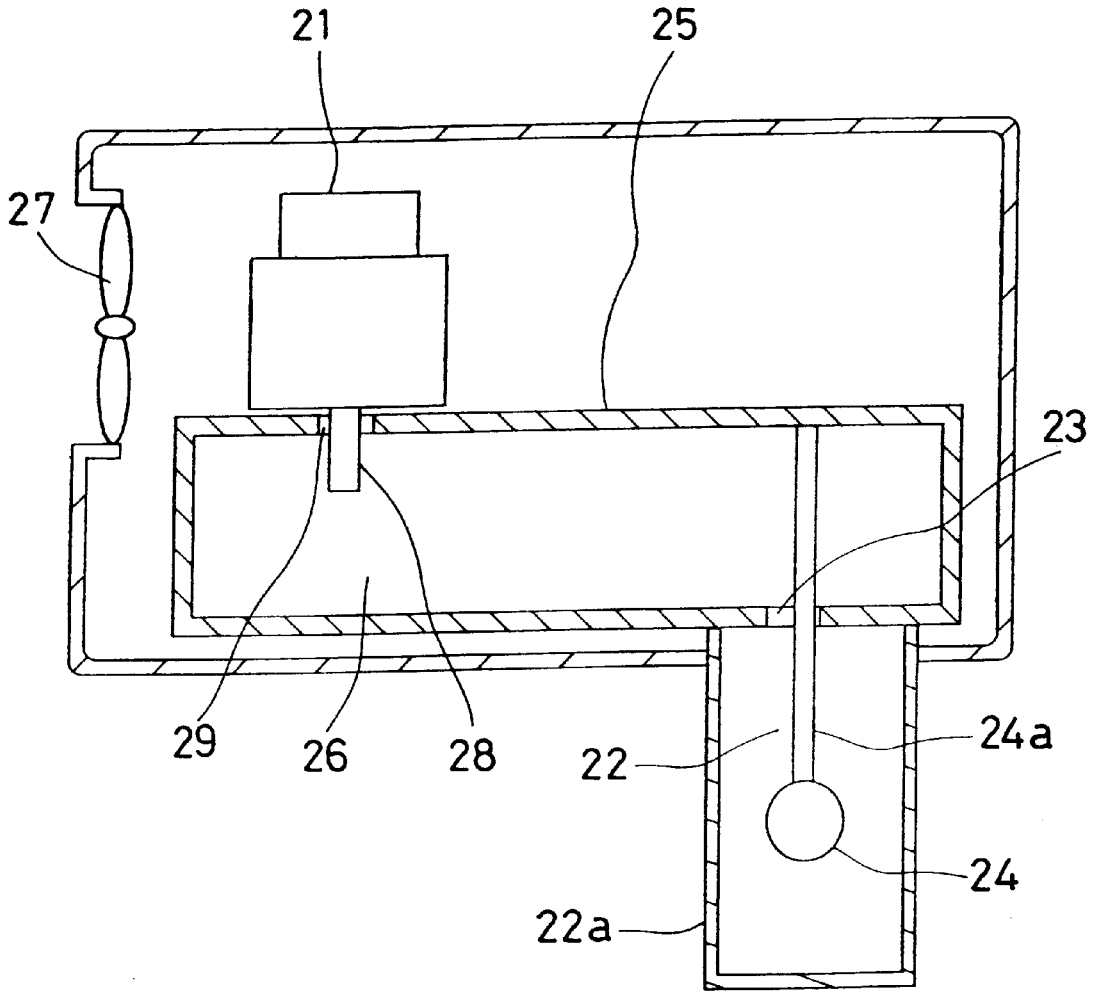
FIG. 2 illustrates a microwave discharge process for the electrodeless discharge lamp shown in FIG. 1.
Figure 3:
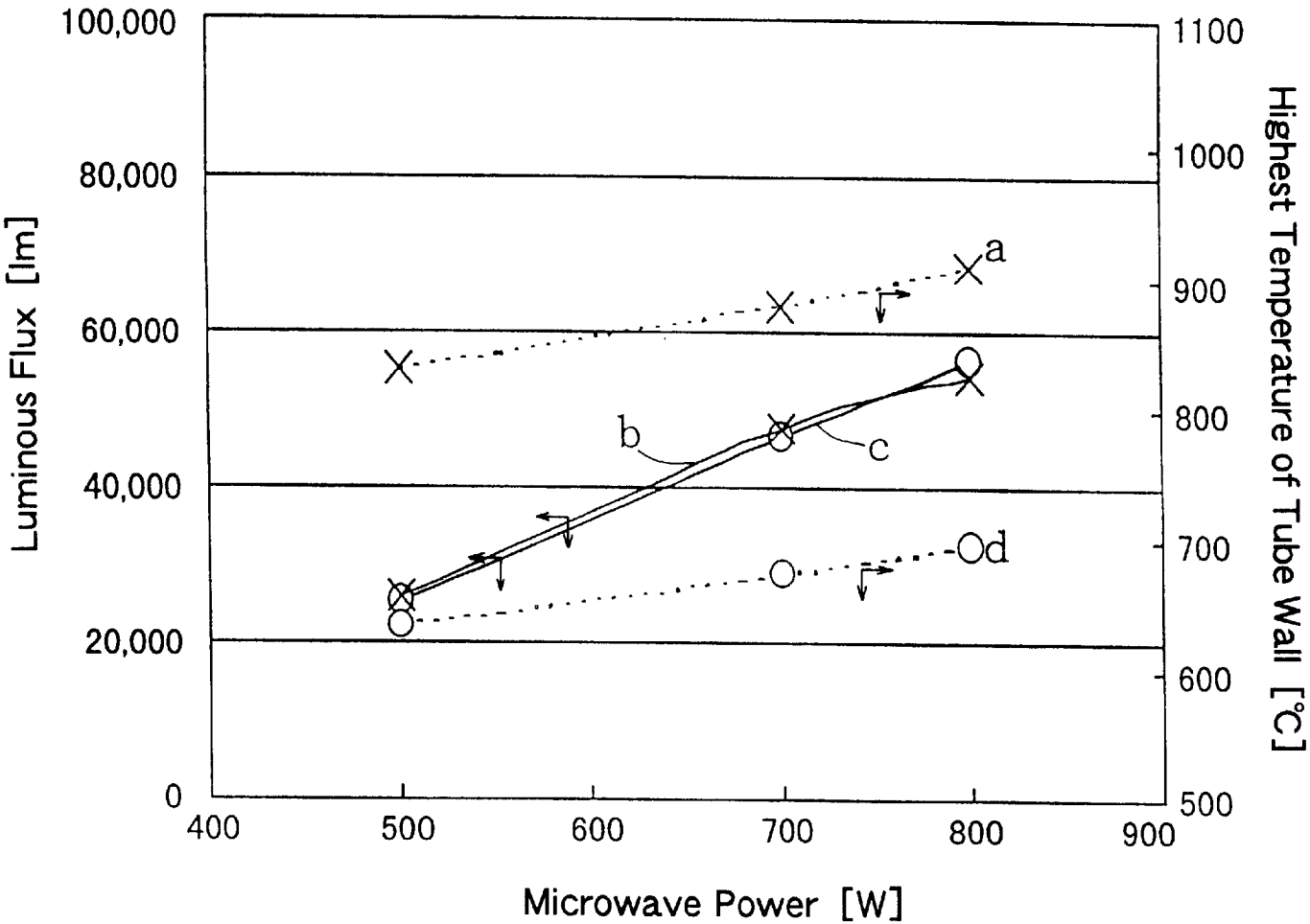
FIG. 3 (PRIOR ART)
FIG. 3 is a graph showing the comparison between lamp output of a conventional electrodeless discharge lamp when the lamp is rotated (c, d) and when the lamp is not rotated (a, b).

FIG. 2 illustrates the microwave discharge process for the electrodeless discharge lamp 24 shown in FIG. 1. As shown, the electrodeless discharge lamp 24 is disposed within a microwave cavity 22 and is supported by a supporting rod 24*a*. The microwave cavity 22 communicates with a transmission space 26 in a waveguide 25 through a power-supply port 23 provided in the wall of the waveguide 25. The waveguide 25 is disposed within a cavity member 22*a*. A magnetron 21 is positioned on the waveguide 25 with its antenna 28 inserted into the waveguide 25 through a slot 29 in the waveguide 25. The magnetron 21 is driven while being cooled forcibly by a cooling fan 27 so as to be prevented from being overheated. Microwaves generated by the magnetron 21 are transmitted from the antenna to the microwave cavity 22 through the waveguide 25. The microwave energy excites the luminescent material 9 within the electrodeless discharge lamp 24, thus allowing the luminescent material 9 to emit light. Before the luminescent material 9 starts to emit light, the noble gas in the envelope 8 initially starts to discharge, causing high temperatures within the envelope 8 and a rise in vapor pressure of the noble gas. The high temperatures and increased vapor pressure within the envelope 8 causes the luminescent material 9 to evaporate and start to discharge. Subsequently, the vapor pressure of the luminescent material rises and its molecules are excited by the microwave energy to emit light.

Figure 4:
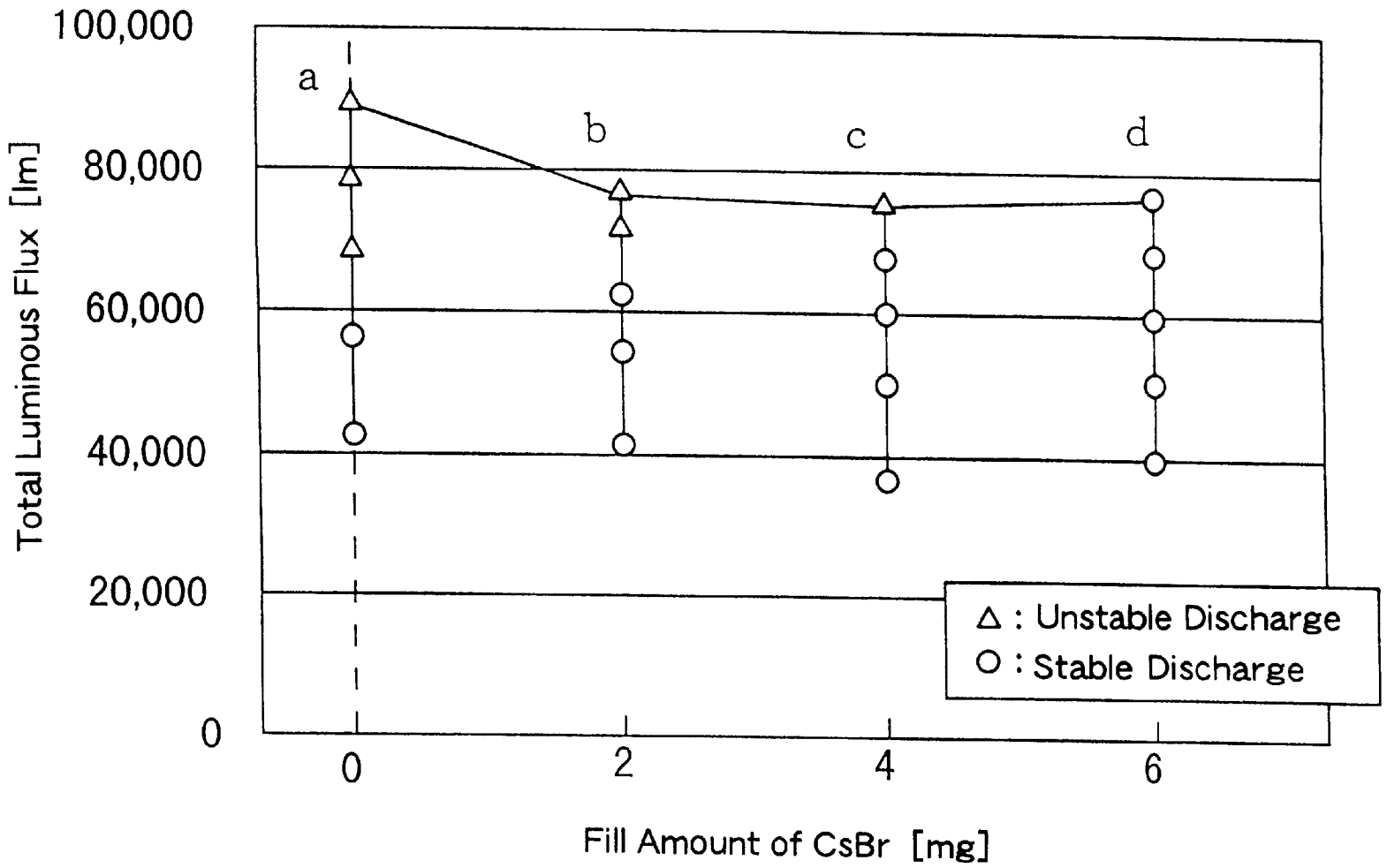
FIG. 4 is a graph showing luminous efficacy and discharge stability of a lamp according to an embodiment of the invention.
Figure 5:
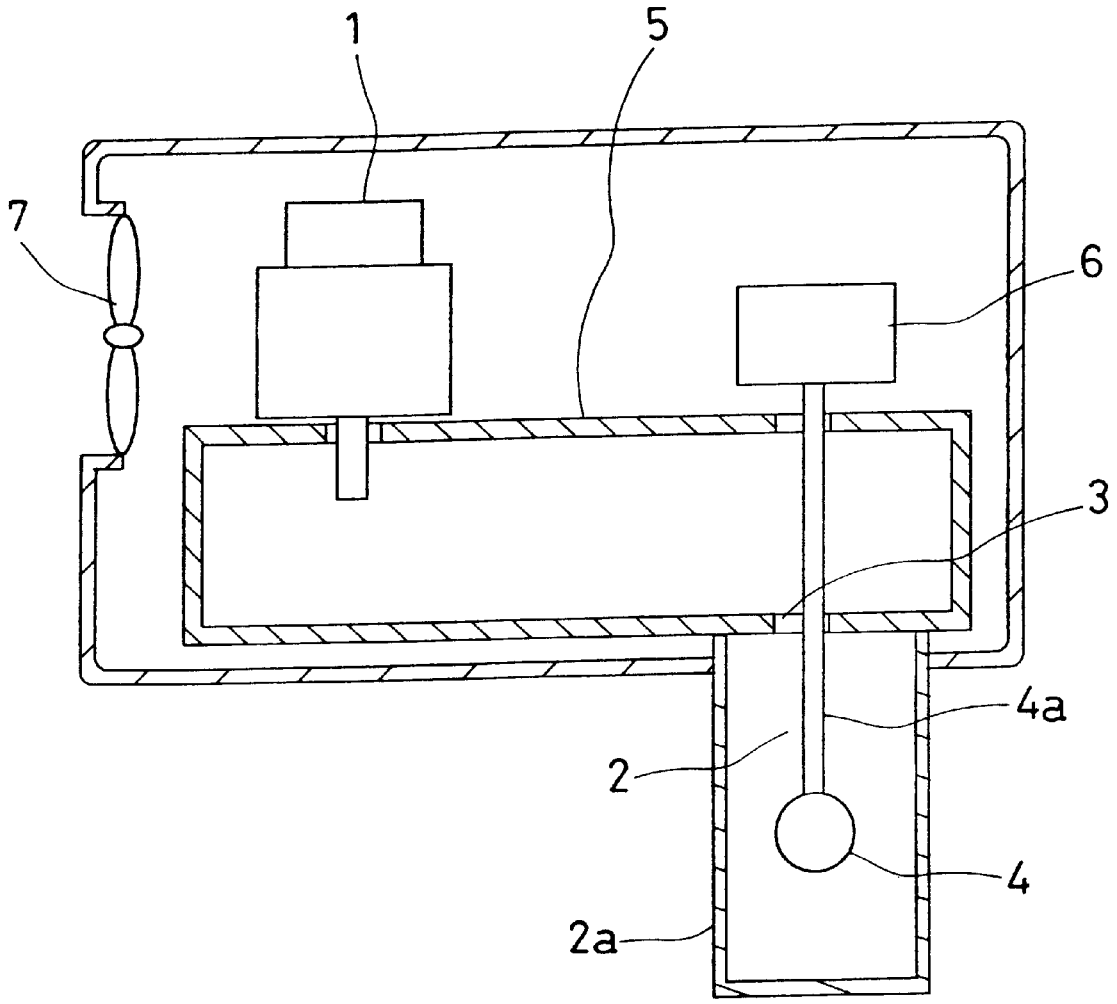
FIG. 5 (PRIOR ART)
FIG. 5 is a schematic view of a conventional electrodeless discharge lamp device.

The effect of CsBr on luminous efficacy and discharge stability of the electrodeless discharge lamp 24 was examined. In the study, an anhydrous quartz glass bulb, sold under the trade name GE214A, with an inner diameter of 30 mm and a wall thickness of 1.2 mm was filled with 40 mg InBr, 5.8 mg CsBr, and 1.3 kPa Ar. Electrodeless discharge lamps with various amounts of CsBr were operated by microwaves with a traveling-wave power of 850W produced by the magnetron. The luminous efficacy and discharge stability of the electrodeless discharge lamps were examined. The data obtained are shown in FIG. 4. The horizontal axis indicates a fill amount of CsBr, and the vertical axis indicates luminous fluxes of lamps after five minutes operation.

In FIG. 4, the symbol Δ shows an unstable discharge causing a lighting condition with flickering, and the symbol ○ indicates a stable discharge. The figure shows brightness and stability of discharge tubes a, b, c, and d filled with different amounts of CsBr when the respective discharge tubes are operated with different electric powers. The respective symbols from the bottom to the top show the values when powers of 500 W, 600 W, 700 W, 800 W, and 900 W were supplied. According to this data, in the discharge tubes, the smaller the fill amount of CsBr is, the lower is the threshold of supply power achieving a stable discharge. Therefore, the discharge tubes cannot be operated with high power, thus limiting the quantity of luminous flux obtained. It can be seen that the value indicating the brightness in the stable discharge achieved by adding a suitable amount of CsBr is higher than that in a stable discharge achieved not by adding CsBr but by lowering the lighting power.

In addition, the presence of free metal indium produced by the operation was checked, and no free metal indium was found in the discharge tubes in which CsBr was added. In the discharge tube in which no CsBr was added, indium adhered to the discharge tube, thus causing devitrification of the quartz tube. Therefore, it is expected that the occurrence of devitrification can be lessened in the discharge tubes in which CsBr was added. In view of this, a continuous operation test was carried out. In the discharge tube in which no CsBr was added, devitrification behavior that was clearly determined visually occurred in a part of the quartz tube before the lamp was operated for about 500 hours continuously. On the other hand, in the discharge tubes in which CsBr was added, the devitrification did not occur even when the lamp was operated for 1000 hours.

Although the embodiment described above has been described with respect to using quartz glass to form the envelope 8, it should be clear that other materials may also be used. For example, the performance of the electrodeless discharge lamp does not diminish when transparent ceramics or the like is used instead of quartz glass. Also, the stabilizing material 10 is not limited to cesium bromide, but could be cesium iodide or other cesium halide in general. Furthermore, indium bromide was used as the indium halide of the luminescent material 9, but other halides such as, for example, iodide or the like, can be used to achieve the same discharge from the electrodeless discharge lamp. Moreover, halides of gallium or thallium can be used instead of indium halide. In general, a halide of a metal selected from a group consisting of gallium, indium, and thallium can be used as the luminescent material, and the same effects can be obtained. Further, the noble gas is not limited to Ar. When a gas heavier than Ar, such as krypton (Kr), xenon (Xe), or the like, is used, the effect for promoting the halogen cycling can be obtained, thus further improving the effect for suppressing the devitrification.

In the embodiment shown in FIG. 2, the microwave cavity 22 is cylindrical in shape, and the waveguide 25 is rectangular in shape. However, it should be clear that the shapes of the microwave cavity 22 and the waveguide 25, and the manner in which the microwave cavity 22 is coupled to the waveguide 25 are not limited to the specific embodiment shown in FIG. 2. For example, the microwave cavity 22 may include a light reflector formed of a conductive material in a paraboloid shape, a conductive mesh provided so as to cover an opening of the light reflector in a direction in which light is irradiated, and so forth. In addition, the cavity member 22*a* which also serves to allow light to be irradiated efficiently may be used.

The cavity member 22*a* is formed, for example, by welding a metal mesh plate formed by etching. However, in order to secure further strength and light transmittance, a member capable of intercepting the transmission of a microwave may be used, which is obtained by using, for example, heat-resistant glass, transparent ceramics, or the like, as a base member and allowing a conductive mesh material with a narrow linewidth to adhere to the outer surface of the base member, or a conductive material to form a mesh-like thin film on the outer surface of the base member.

In the embodiment illustrated in FIG. 2, a microwave of 2.45 GHz is used as an energy supply means for operating the electrodeless discharge lamp 24, the magnetron 21 as an oscillator for generating the microwave, and the waveguide 25 as a microwave transmission member. However, members for applying energy are not limited to this specific setup. For instance, a solid-state high-frequency oscillator can be used instead of the magnetron 21, and a waveguide such as a coaxial line, or the like, also can be used as the transmission member. Further, an inductively coupled electrodeless discharge system which does not require the microwave of 2.45 GHz can also be used. For example, a high frequency of 13.56 MHz may be applied to a coil provided inside or outside the electrodeless discharge lamp 24, and an induced current may be allowed to flow inside the lamp by a high-frequency field to cause a discharge.

The invention described above provides various advantages. For example, an electrodeless discharge lamp having a stable discharge is provided by filling an envelope with a luminescent material which emits light and a filling material which does not substantially emit light but stabilizes a discharge from the luminescent material. Therefore, stable discharges and, thus, stable light emission can be achieved without rotating the envelope. In addition, the stabilizing material acts to suppress the devitrification of the envelope, thus providing a highly reliable long-lifetime electrodeless discharge lamp device.

While the invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. An electrodeless discharge lamp, comprising:

an envelope filled with a luminescent material to be excited to emit light and a filling material that substantially does not emit light, wherein the filling material stabilizes a discharge of the luminescent material, wherein the luminescent material is a metal halide, the filling material is cesium halide, which is used to stabilize the light emitted by the luminescent material and to suppress devitrification of quartz glass or transparent ceramics, and wherein a fill amount of the luminescent material is in a range between $0.5\times10^{-6}$ mol/cc and $1.0\times10^{-4}$ mol/cc, and the electrodeless discharge lamp is excited by one selected from the group consisting of microwave and a high-frequency oscillator, wherein a fill amount of the cesium halide is n times as large as a fill amount of the luminescent material, where n equals (0.0005×P)−0.28, and where P is a value in watts that denotes an input electric power to the lamp.

2. The electrodeless discharge lamp according to claim 1, wherein the luminescent material is a metal halide of metal selected from the group consisting of gallium, indium, and thallium.

3. The electrodeless discharge lamp according to claim 1, wherein the envelope is further filled with a noble gas selected from a group consisting of argon (Ar), krypton (Kr), and xenon (Xe), and wherein the noble gas serves as a starting auxiliary gas.

4. The electrodeless discharge lamp according to claim 1, wherein the envelope is formed from quartz glass.

5. The electrodeless discharge lamp according to claim 1, wherein the envelope is not rotated and no mechanism for rotating the envelope is required.

6. The electrodeless discharge lamp according to claim 1, wherein the envelope is formed from transparent ceramics.

7. An electrodeless discharge lamp device, comprising:

an electrodeless discharge lamp having an envelope filled with a luminescent material to be excited to emit light and a filling material that substantially does not emit light, wherein the filling material stabilizes a discharge of the luminescent material; and means for exciting the luminescent material, wherein the luminescent material is a halide of a metal selected from the group consisting of gallium, indium, and thallium, the filling material is cesium halide, which is used to stabilize the light emitted by the luminescent material and to suppress devitrification of quartz glass or transparent ceramics, and wherein a fill amount of the luminescent material is in a range between $0.5\times10^{-6}$ mol/cc and $1.0\times10^{-4}$ mol/cc, and the electrodeless discharge lamp is excited by one selected from the group consisting of microwave and a high-frequency oscillator, wherein a fill amount of the cesium halide is n times as large as a fill amount of the luminescent material, where n equals (0.0005×P)−0.28, and where P is a value in watts that denotes an input electric power to the lamp.

8. The electrodeless discharge lamp device of claim 7, wherein the means for exciting the luminescent material comprises microwave energy.

9. An electrodeless discharge lamp device, comprising:

an electrodeless discharge lamp having an envelope filled with a luminescent material to be excited to emit light; and means for stabilizing a discharge of the luminescent material, wherein the luminescent material is a halide of a metal selected from the group consisting of gallium, indium, and thallium, a filling material of cesium halide, which is used to stabilize the light emitted by the luminescent material and to suppress devitrification of quartz glass or transparent ceramics, and wherein a fill amount of the luminescent material is in a range between $0.5\times10^{-6}$ mol/cc and $1.0\times10^{-4}$ mol/cc, and the electrodeless discharge lamp is excited by one selected from the group consisting of microwave and a high-frequency oscillator, wherein a fill amount of the cesium halide is n times as large as a fill amount of the luminescent material, where n equals (0.0005×P)−0.28, and where P is a value in watts that denotes an input electric power to the lamp.

10. A method for producing a stabilized discharge in an electrodeless discharge lamp, comprising:

filling an envelope of the electrodeless discharge lamp with a luminescent material and a filling material; and exciting the luminescent material to emit light, wherein the filling material stabilizes the emitted light, the luminescent material is a halide of a metal selected form the group consisting of gallium, indium, and thallium, the filling material is cesium halide, which is used to stabilize the light emitted by the luminescent material and to suppress devitrification of quartz glass or transparent ceramics, and wherein a fill amount of the luminescent material is in a range between $0.5\times10^{-6}$ mol/cc and $1.0\times10^{-4}$ mol/cc, and the electrodeless discharge lamp is excited by one selected from the group consisting of microwave and a high-frequency oscillator, wherein a fill amount of the cesium halide is n times as large as a fill amount of the luminescent material, where n equals (0.0005×P)−0.28, and where P is a value in watts that denotes an input electric power to the lamp.

* * * * *